US011291926B2

(12) United States Patent
Miyazaki

(10) Patent No.: US 11,291,926 B2
(45) Date of Patent: Apr. 5, 2022

(54) POLYHEDRAL TOY

(71) Applicant: HANAYAMA INTERNATIONAL TRADING LIMITED, Chiba (JP)

(72) Inventor: Keiichi Miyazaki, Kanagawa (JP)

(73) Assignee: HANAYAMA INTERNATIONAL TRADING LTD, Hong Kong (CN)

( * ) Notice: Subject to any disclaimer, the term of this patent is extended or adjusted under 35 U.S.C. 154(b) by 16 days.

(21) Appl. No.: 16/617,361

(22) PCT Filed: May 29, 2017

(86) PCT No.: PCT/JP2017/019927
§ 371 (c)(1),
(2) Date: May 28, 2020

(87) PCT Pub. No.: WO2018/220680
PCT Pub. Date: Dec. 6, 2018

(65) Prior Publication Data

US 2021/0146270 A1 May 20, 2021

(51) Int. Cl.
*A63H 33/08* (2006.01)

(52) U.S. Cl.
CPC ..... *A63H 33/08* (2013.01)

(58) Field of Classification Search
CPC ..... A63H 33/08
(Continued)

(56) References Cited

U.S. PATENT DOCUMENTS 2,839,841 A * 6/1958 Berry ..... A63H 33/04 434/278
3,461,574 A * 8/1969 Larsen ..... A63F 9/06 434/403
(Continued)

FOREIGN PATENT DOCUMENTS

EP 0069188 1/1983
JP S53-35697 9/1976
(Continued)

OTHER PUBLICATIONS

Certified Translation of S53-35697; Feb. 13, 2020; 15 pgs.
(Continued)

*Primary Examiner* — Eugene L Kim
*Assistant Examiner* — Matthew B Stanczak
(74) *Attorney, Agent, or Firm* — K&L Gates LLP

(57) ABSTRACT

An object is to provide, in place of a cube toy such as Yoshimoto Cube, a wide variety of playing patterns, playing patterns which cannot be predicted in terms of change in forms, a polyhedral toy which can be enjoyed in terms of change in form even when only one polyhedral toy is used, and a polyhedral toy having extensibility for achieving a wide variety of contents of play through combination of two or more polyhedral toys. Therefore, when a polyhedral piece (U1) forming the toy is formed with three quadrangular pyramids (G1 to G3) having, among six triangular faces (T1 to T6) of a cube (R), three faces (R1 to R3) as bottom faces, the polyhedral piece (U1) includes a triangle surface (10) formed of six triangular faces (T1 to T6) other than respective side faces of the quadrangular pyramids (G1 to G3) placed on one another. When polyhedral pieces (U1 to U8) each having the configuration described above form a toy (1) unfolded into a cuboid shape of two rows and four columns as illustrated in FIG. 1, in plan view on a top face of the toy (1), in each of the first row and the second row, the triangle surface (10), the third face (R3), the third face (R3), and the triangle surface (10) are arranged in the stated order.

8 Claims, 21 Drawing Sheets

(58) Field of Classification Search
USPC ..... 434/211, 403; 446/85
See application file for complete search history.

(56) References Cited

U.S. PATENT DOCUMENTS

| | | | | | |
|---|---|---|---|---|---|
| 3,645,535 | A * | 2/1972 | Randolph | A63F 9/12 | 273/157 R |
| 3,659,360 | A * | 5/1972 | Zeischegg | G09B 23/04 | 434/403 |
| 3,787,996 | A * | 1/1974 | Smith | A63H 33/04 | 446/124 |
| 4,258,479 | A * | 3/1981 | Roane | A63H 33/046 | 434/211 |
| 4,317,654 | A * | 3/1982 | Wahl | G09B 23/04 | 434/211 |
| 4,405,131 | A | 9/1983 | Horvath | | |
| 4,461,480 | A | 7/1984 | Mitchell | | |
| 4,573,683 | A * | 3/1986 | Lamle | A63F 9/12 | 273/157 R |
| 4,676,507 | A * | 6/1987 | Patterson | A63F 9/12 | 273/160 |
| 4,723,382 | A * | 2/1988 | Lalvani | E04B 1/3211 | 273/157 R |
| 4,790,759 | A * | 12/1988 | Mosseri | A63H 33/04 | 273/157 R |
| 5,105,589 | A * | 4/1992 | Rodriguez | E04B 1/34331 | 52/653.1 |
| 5,108,100 | A * | 4/1992 | Essebaggers | A63F 9/12 | 273/153 R |
| 5,168,677 | A * | 12/1992 | Pronsato | A63F 9/1208 | 52/81.1 |
| 5,169,352 | A * | 12/1992 | Petersen | A63H 33/04 | 446/117 |
| 5,249,966 | A * | 10/1993 | Hiigli | G09B 23/04 | 434/211 |
| 5,448,868 | A * | 9/1995 | Lalvani | E04B 1/3211 | 52/648.1 |
| 5,645,464 | A * | 7/1997 | Chen | A63H 33/10 | 403/300 |
| 5,651,679 | A * | 7/1997 | Altman | G09B 23/04 | 359/616 |
| 5,660,387 | A * | 8/1997 | Stokes | A63F 9/12 | 273/157 R |
| 6,257,574 | B1 * | 7/2001 | Evans | A63F 9/12 | 273/157 R |
| 7,247,075 | B2 * | 7/2007 | von Oech | A63H 33/04 | 273/153 S |
| 8,061,713 | B2 * | 11/2011 | Cook | A63F 9/1204 | 273/157 R |
| 8,893,451 | B2 * | 11/2014 | Rodriguez | E04B 1/348 | 52/653.1 |
| D801,443 | S * | 10/2017 | Du Toit | D21/499 | |
| D849,850 | S * | 5/2019 | Holowka | D21/484 | |
| 10,722,782 | B2 * | 7/2020 | Hung | A63F 9/1208 | |
| 2002/0058456 | A1 * | 5/2002 | Miller | A63H 33/084 | 446/85 |
| 2002/0172928 | A1 * | 11/2002 | Suchta | G09B 23/02 | 434/211 |
| 2006/0105666 | A1 * | 5/2006 | von Oech | A63H 33/04 | 446/85 |
| 2012/0291365 | A1 * | 11/2012 | Rodriguez | E04H 1/00 | 52/79.9 |

FOREIGN PATENT DOCUMENTS

| | | |
|---|---|---|
| JP | S61-18935 | 6/1986 |
| JP | S63-17504 | 5/1988 |
| JP | S63-36272 | 7/1988 |

OTHER PUBLICATIONS

Certified Translation of S61-18935; Feb. 13, 2020; 6 pgs.
Certified Translation of S63-17504; Feb. 13, 2020; 10 pgs.
Computer Translation of S63-36272; Feb. 21, 2020; 14 pgs.
Author unknown; International Search Report of PCT/JP2017/019927; dated Aug. 22, 2017; 2 pgs.
English Translation of S63-36272; Feb. 21, 2020; 14 pgs.
Author unknown; European Search Report of EP17911988.8; dated Mar. 19, 2021; 7 pgs.

* cited by examiner

[Fig.1]
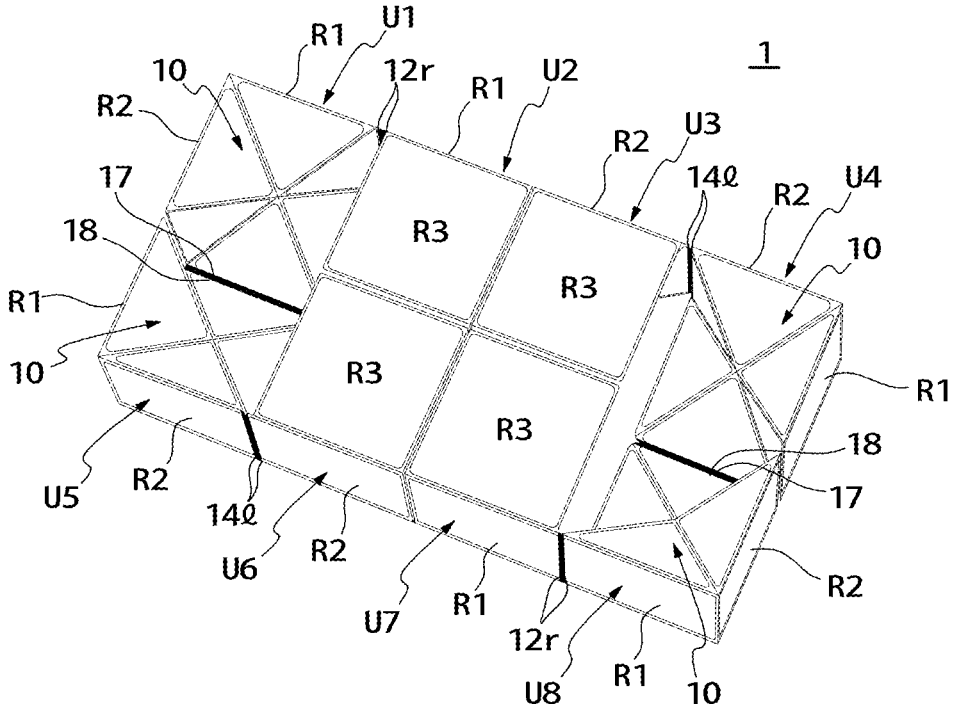
[Fig.2]
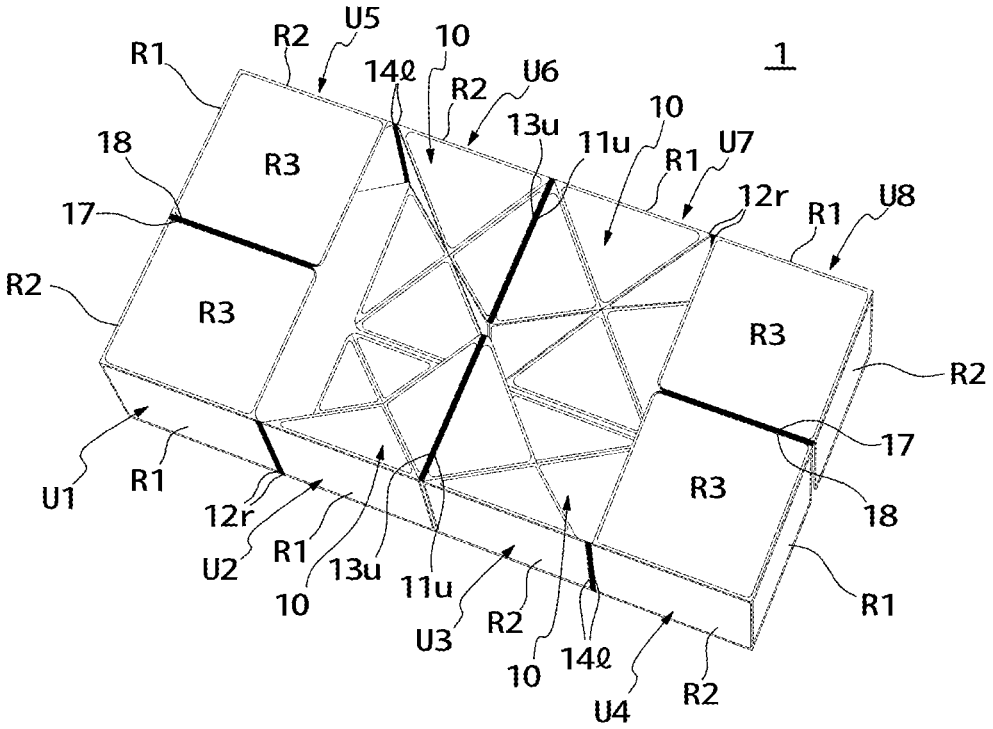

[Fig.3]
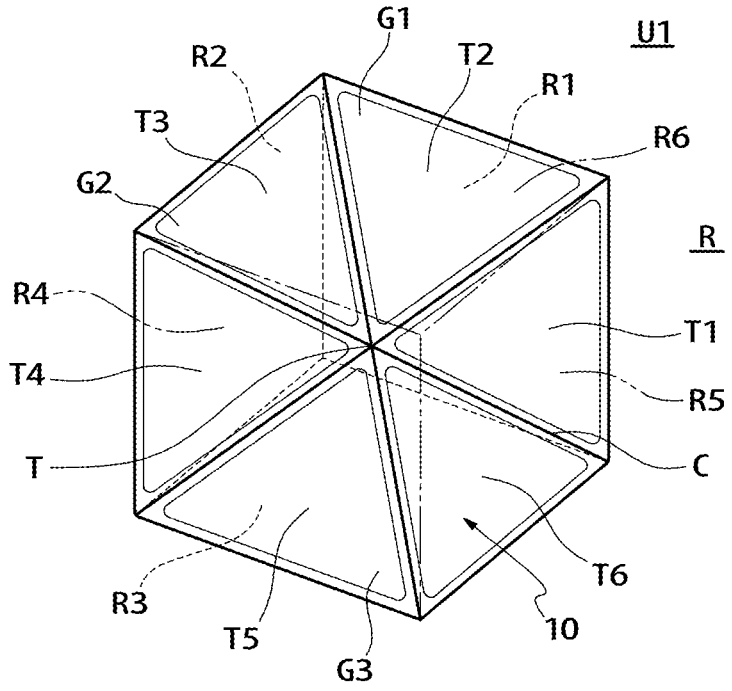
[Fig.4]
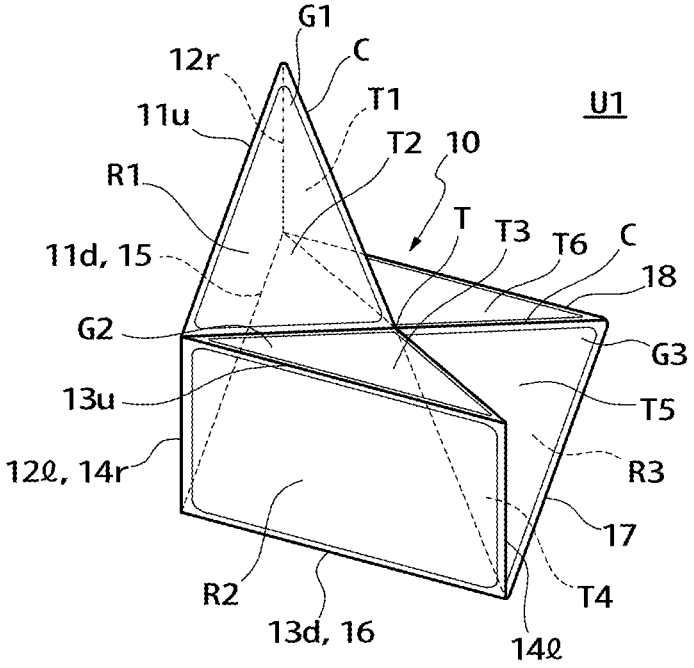

[Fig.5]
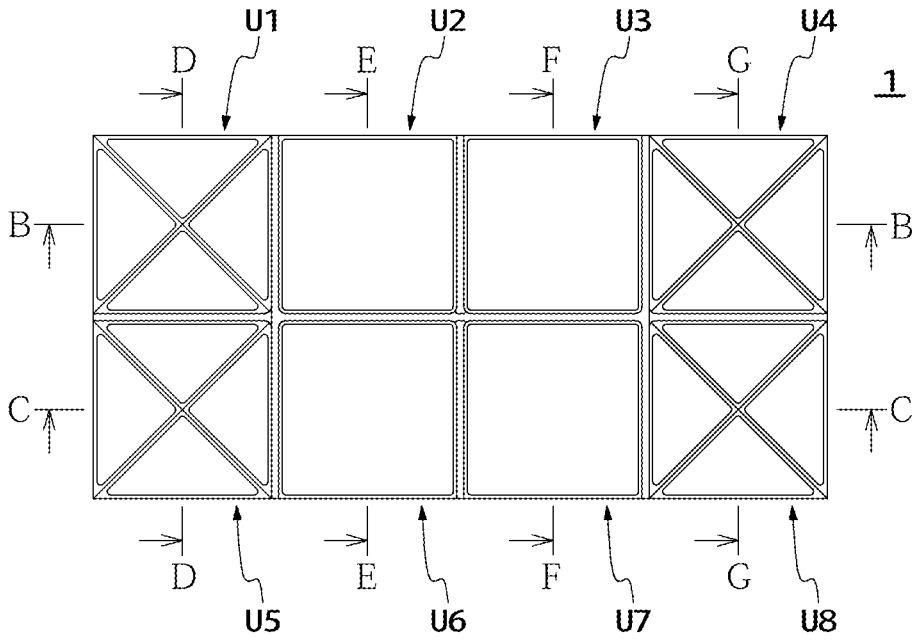
[Fig.6]
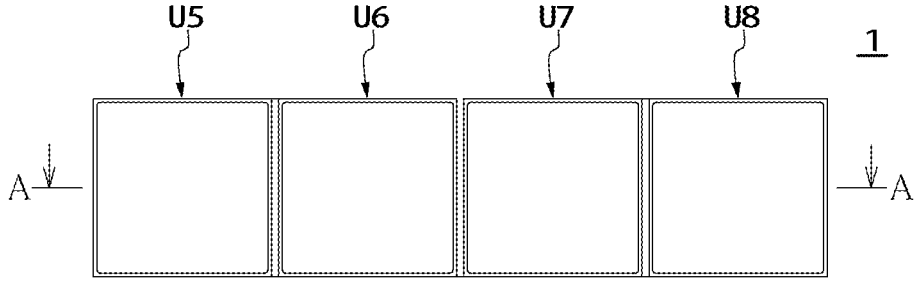

[Fig.7]
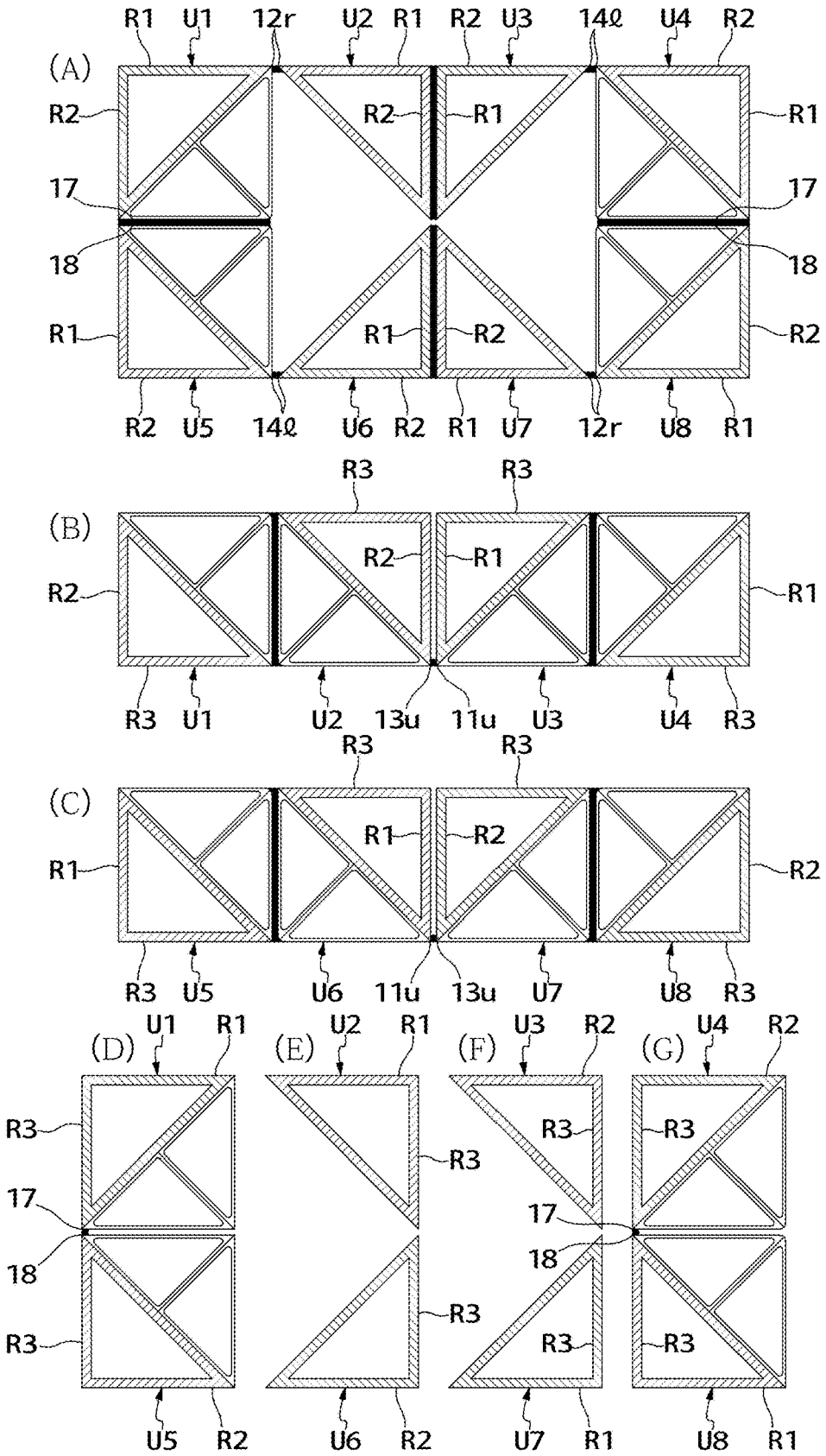

[Fig.8]
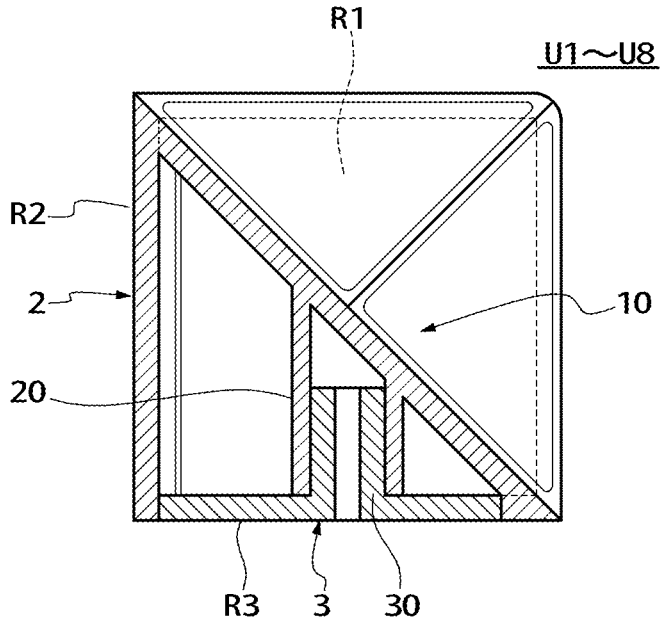
[Fig.9]
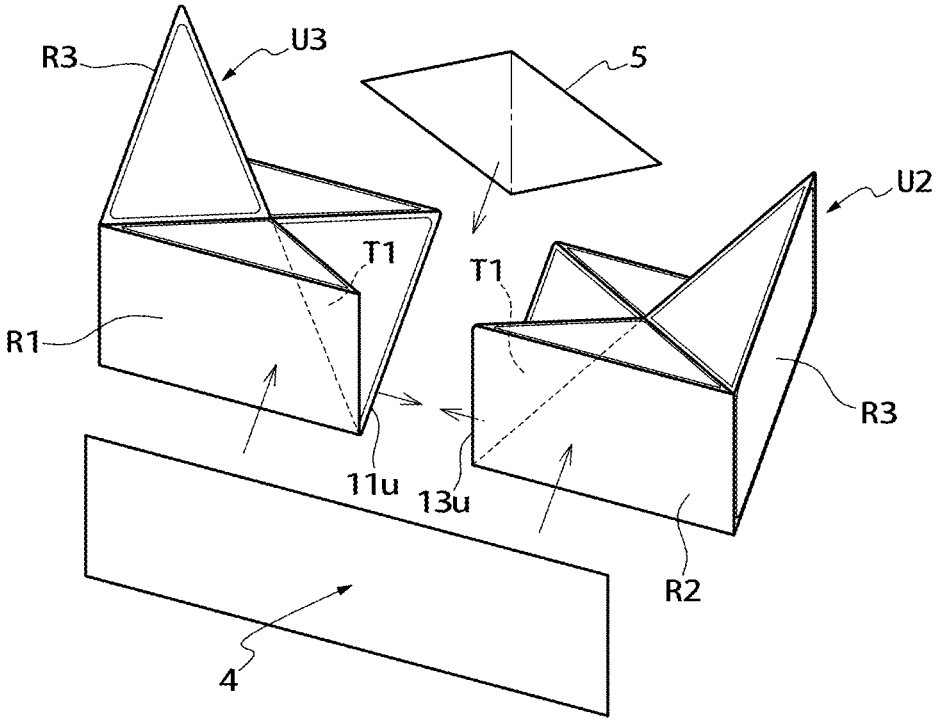

[Fig.10]
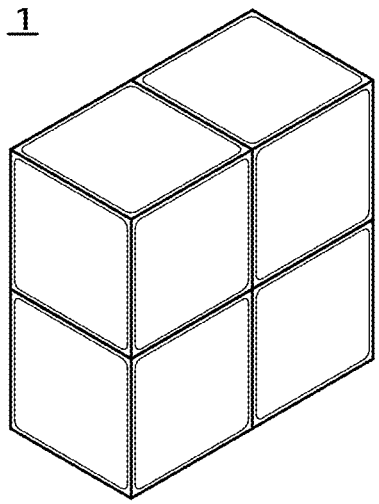
[Fig.11]
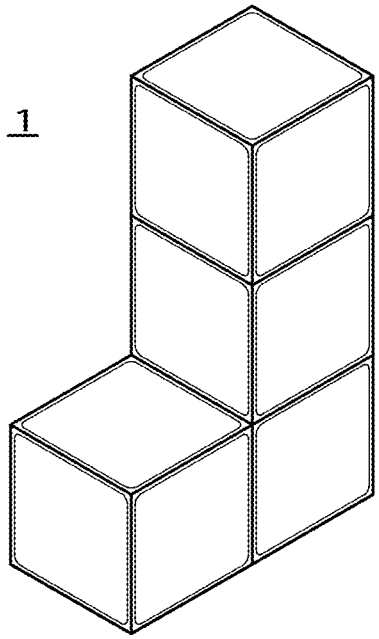

[Fig.12]
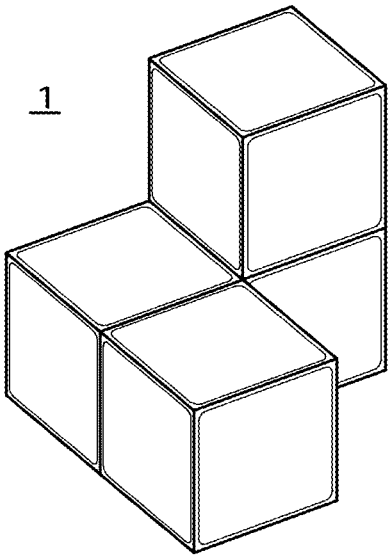
[Fig.13]
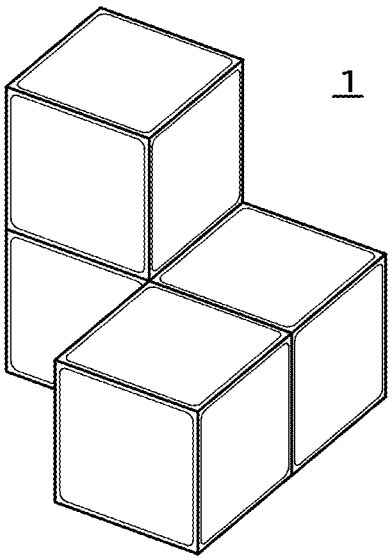

[Fig.14]
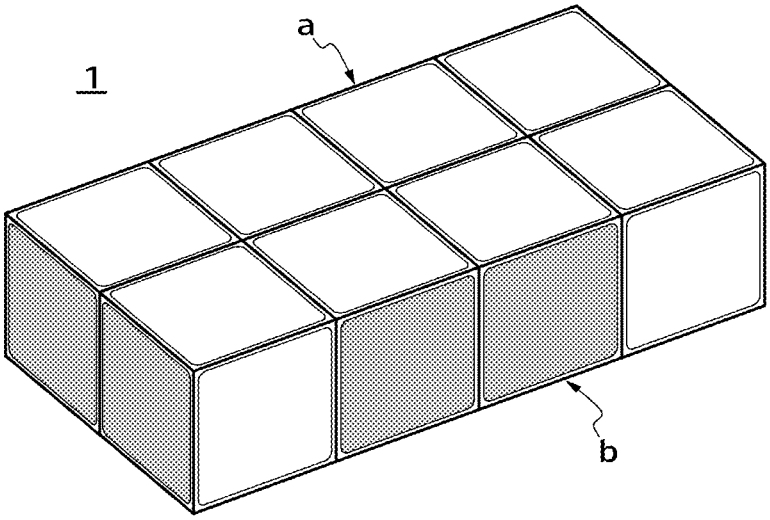
[Fig.15]
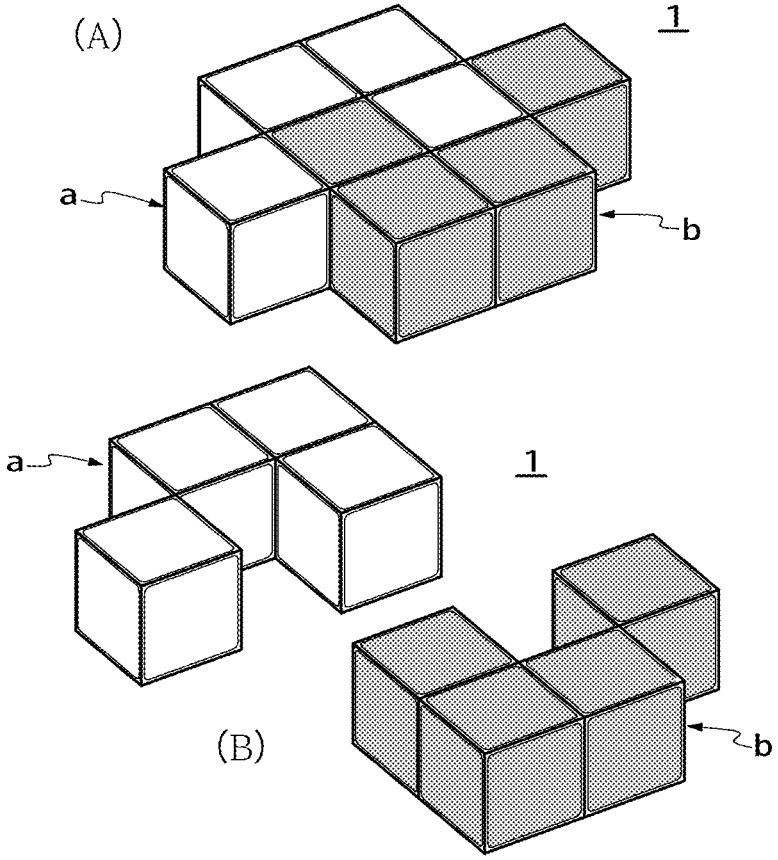

[Fig.16]
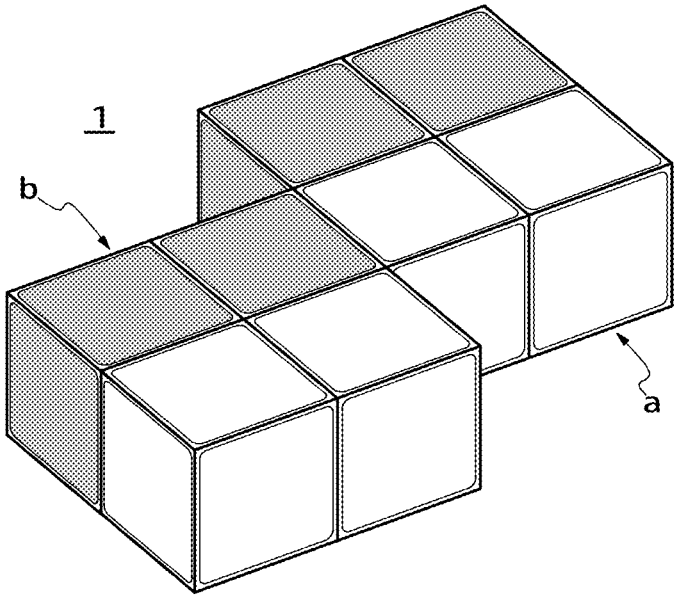
[Fig.17]
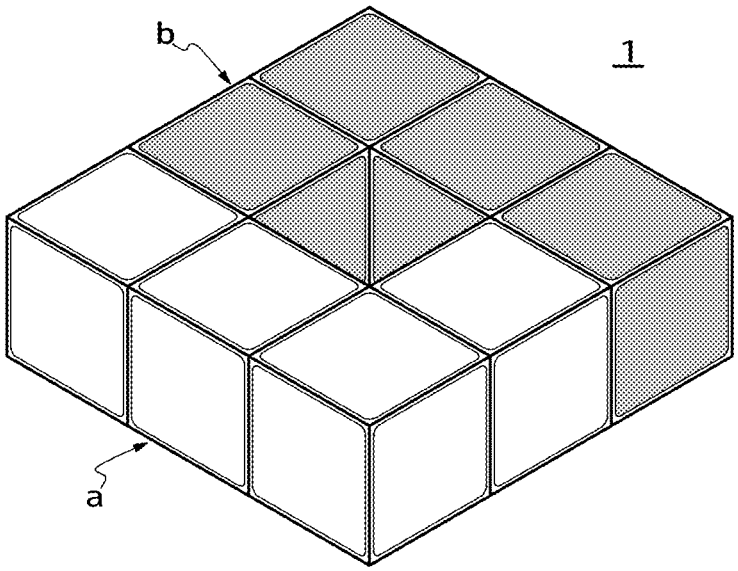

[Fig.18]
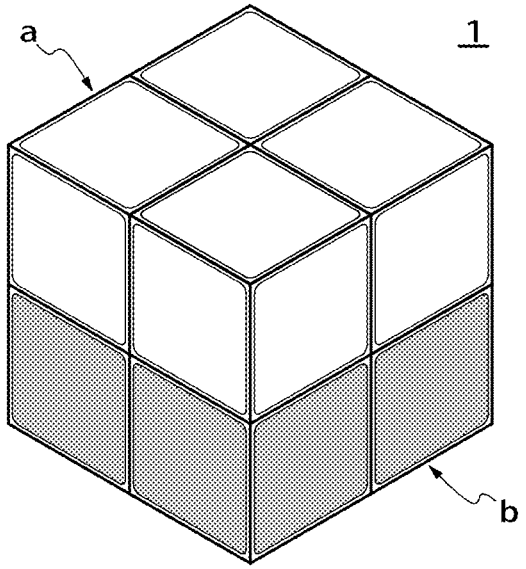
[Fig.19]
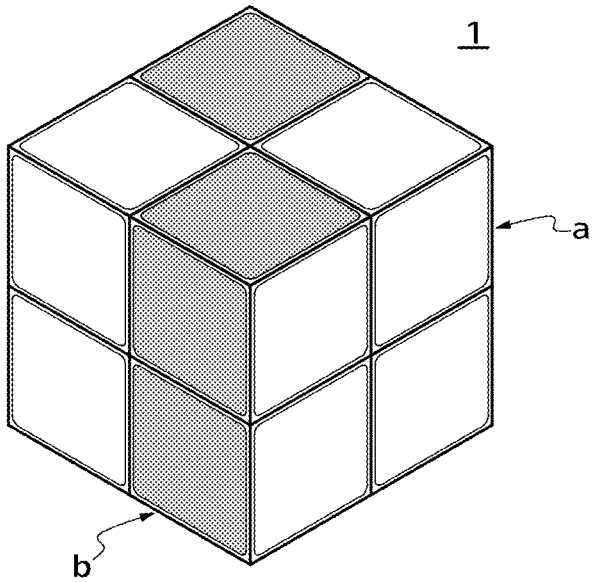

[Fig.20]
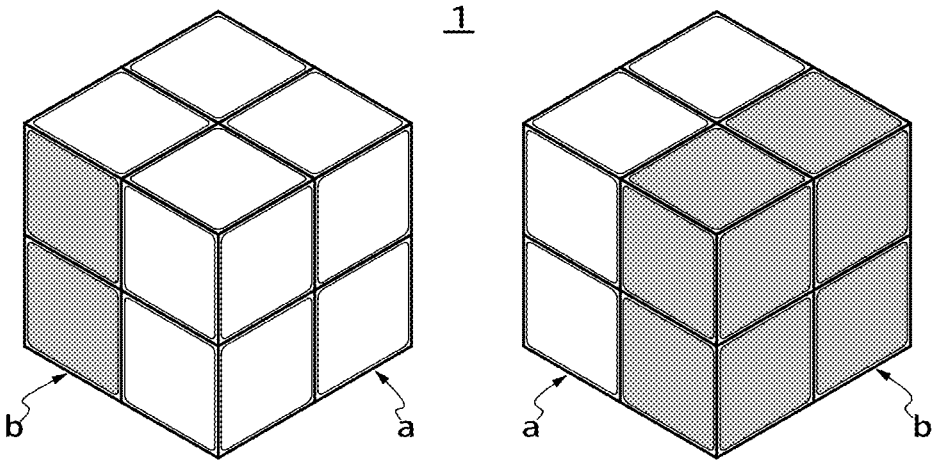
[Fig.21]
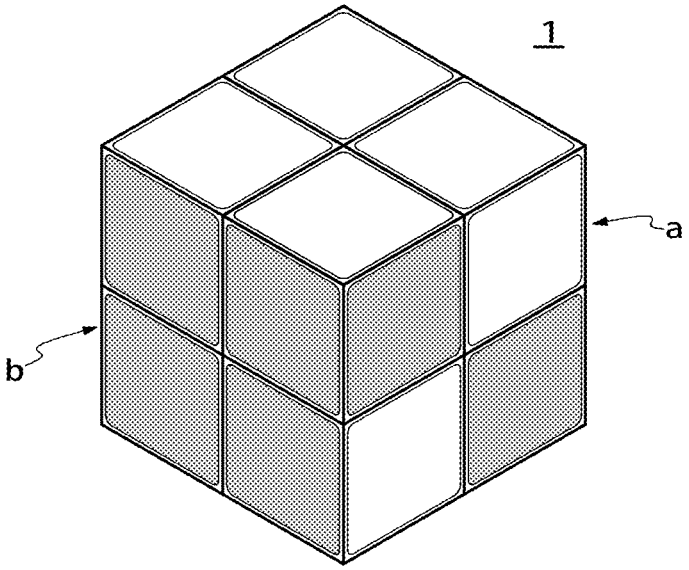

[Fig.22]
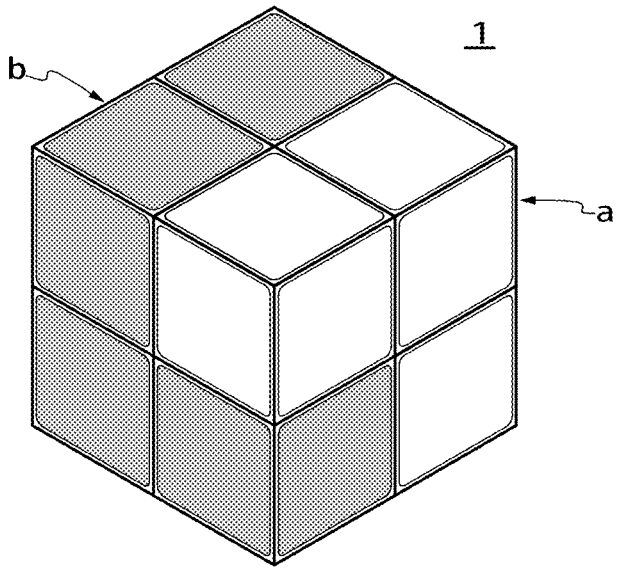
[Fig.23]
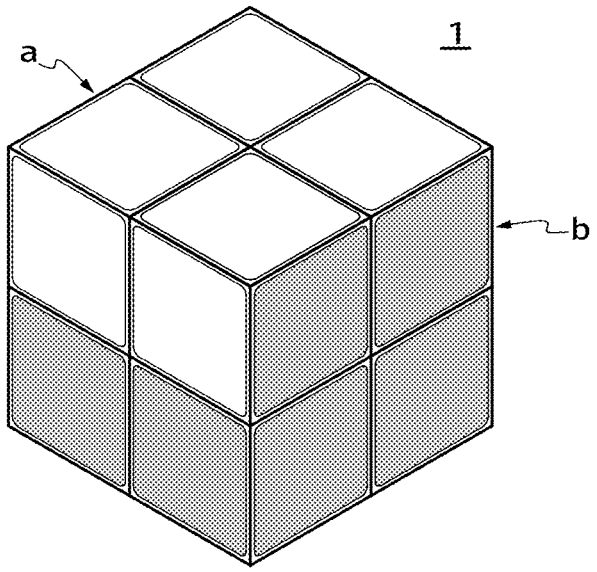

[Fig.24]
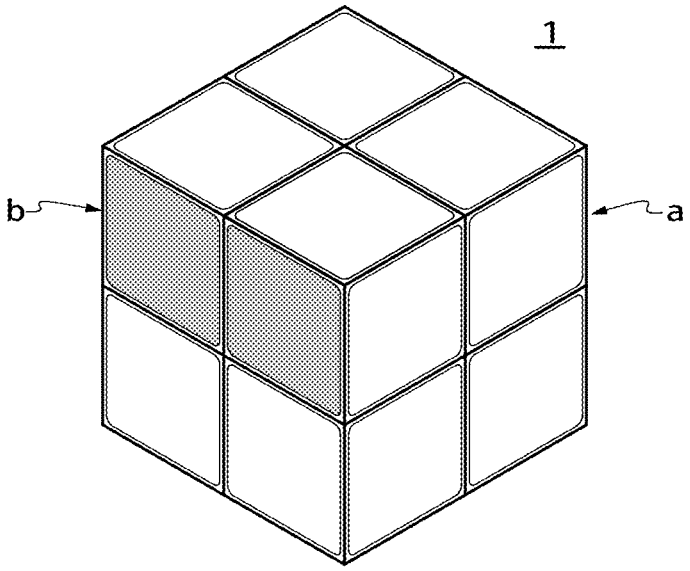
[Fig.25]
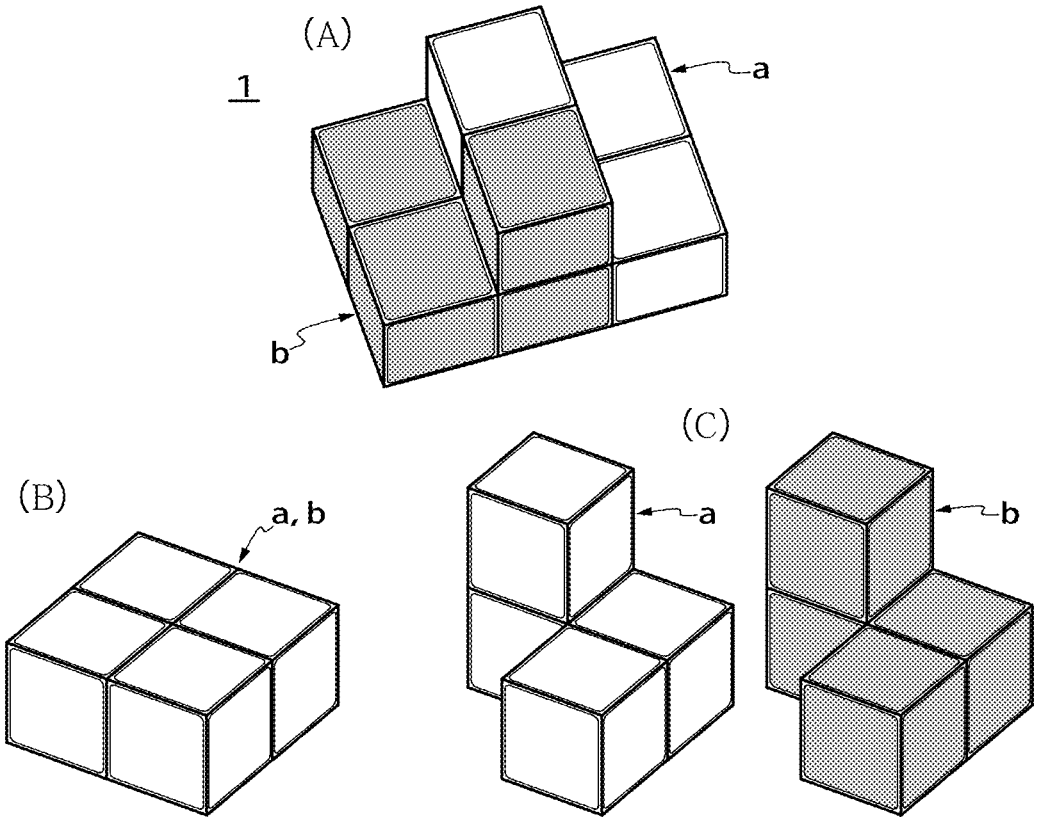

[Fig.26]
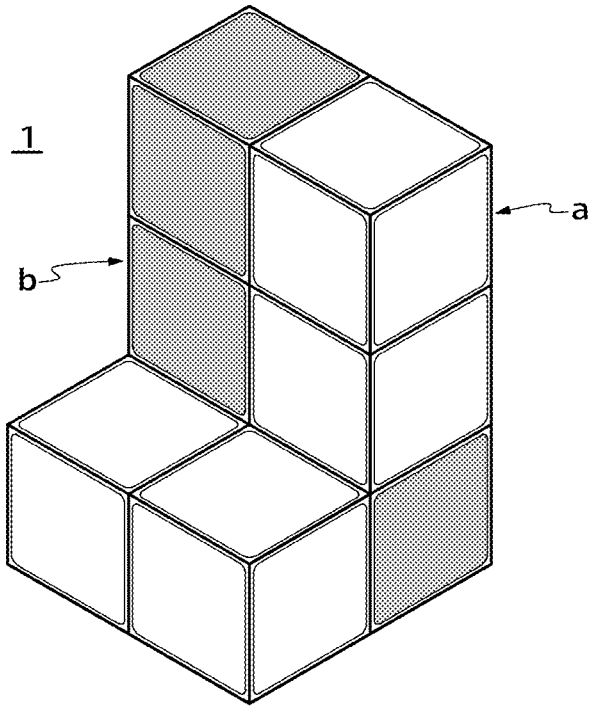
[Fig.27]
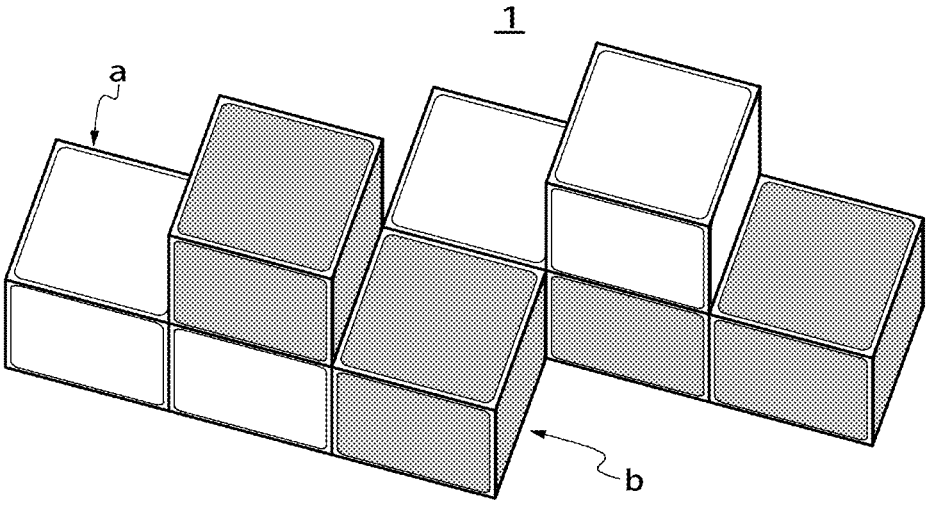

[Fig.28]
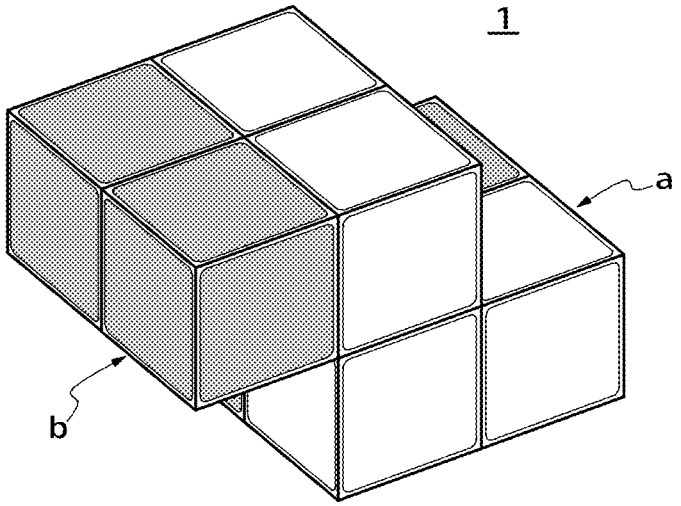
[Fig.29]
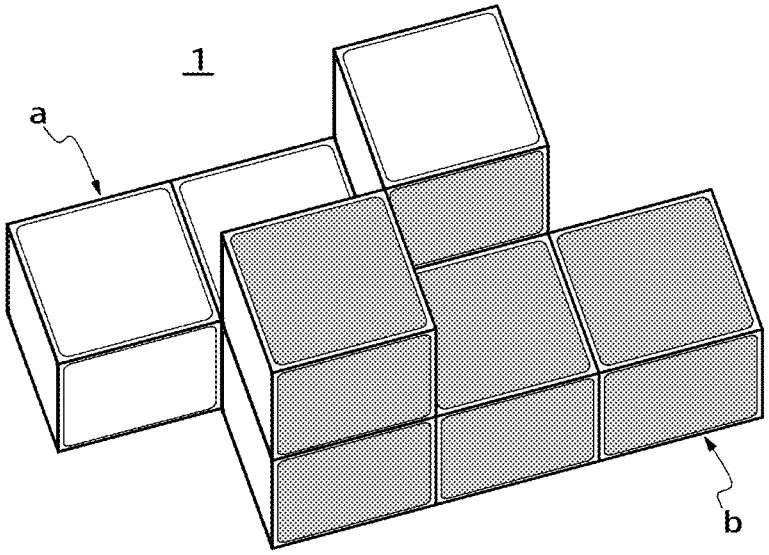

[Fig.30]
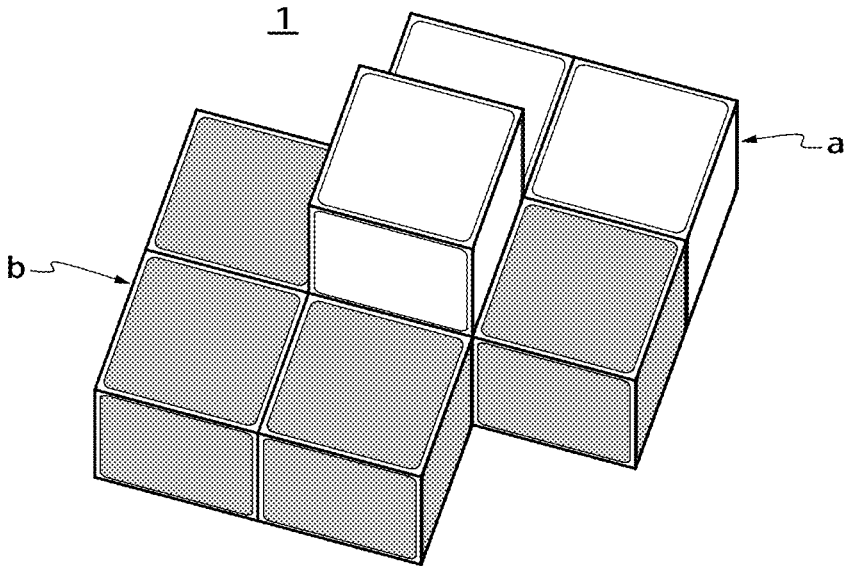
[Fig.31]
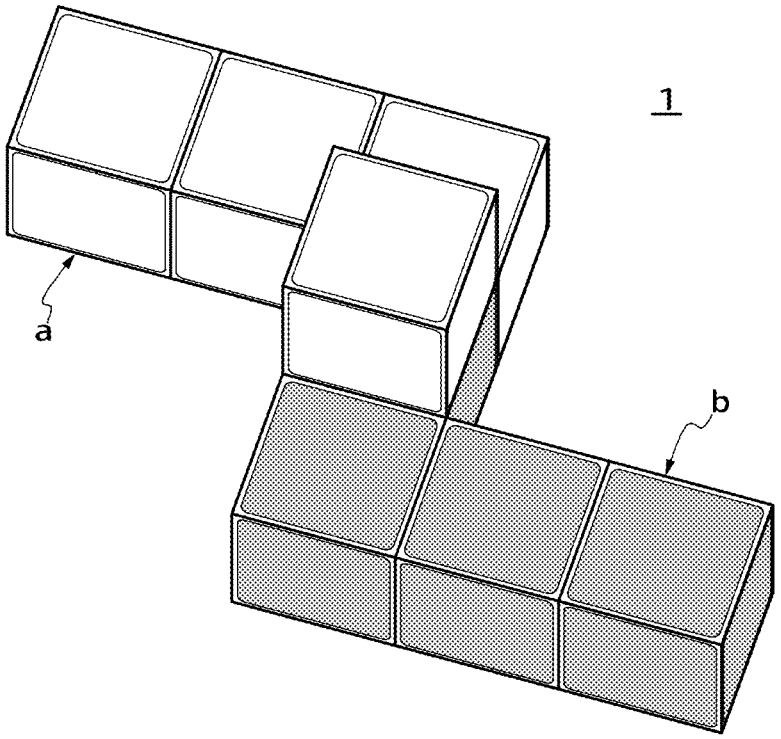

[Fig.32]
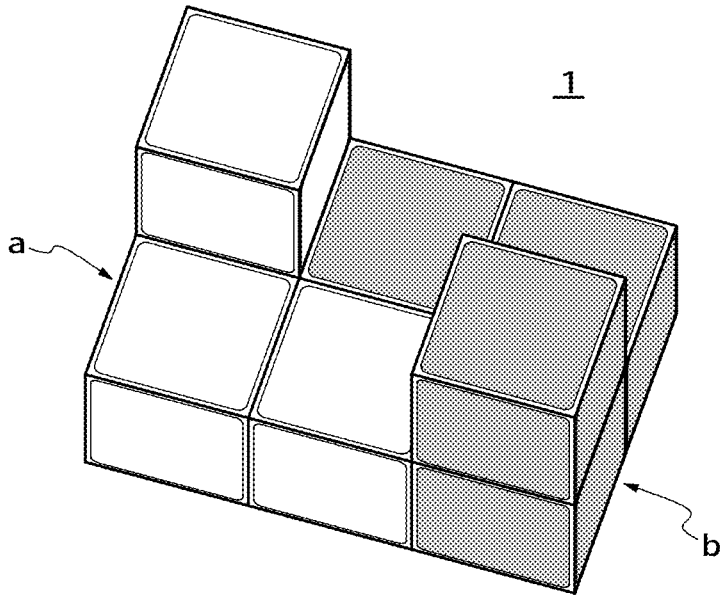
[Fig.33]
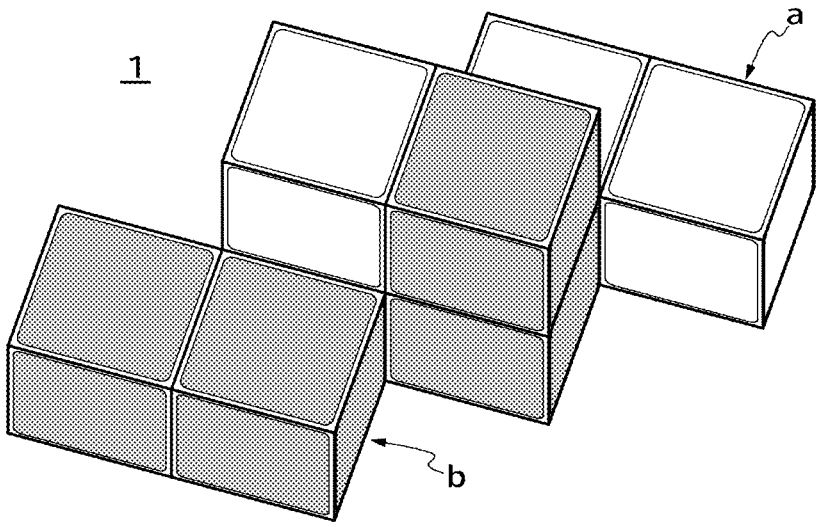

[Fig.34]
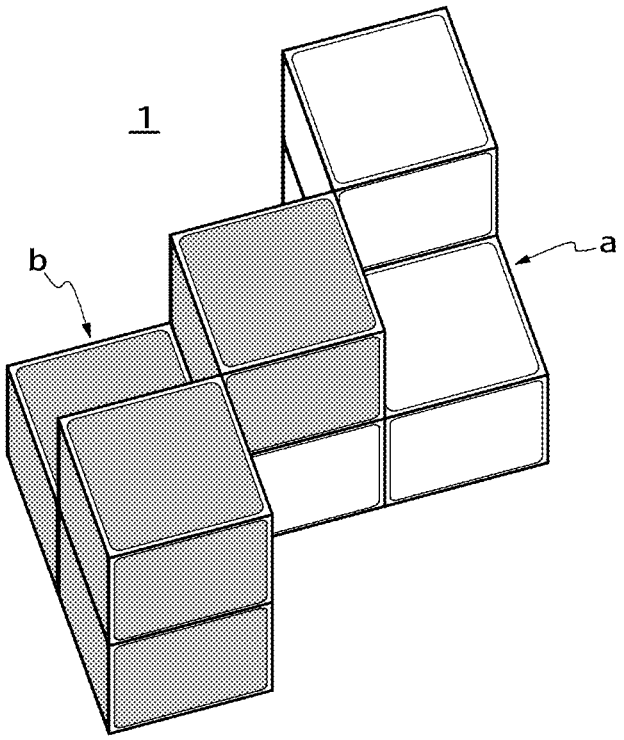
[Fig.35]
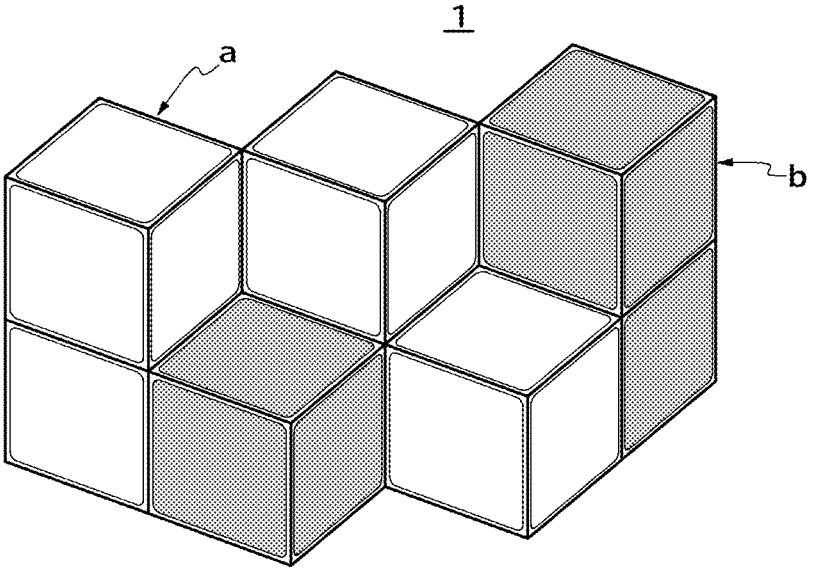

[Fig.36]
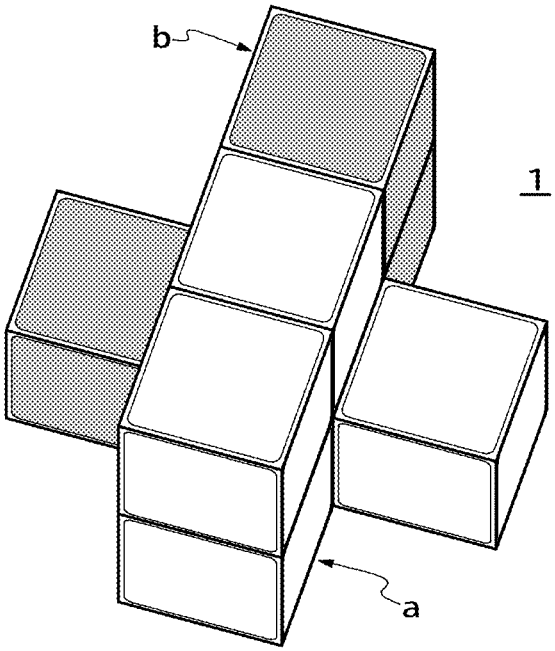
[Fig.37]
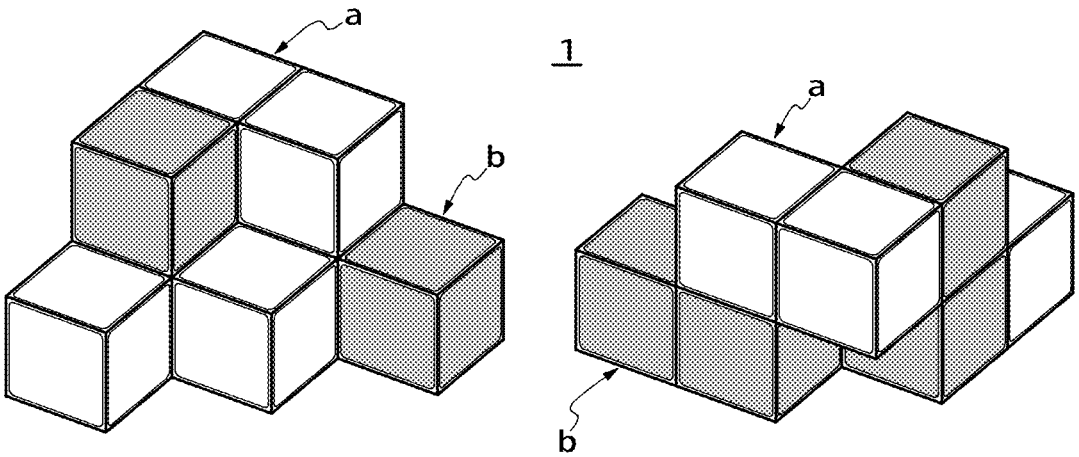

[Fig.38]
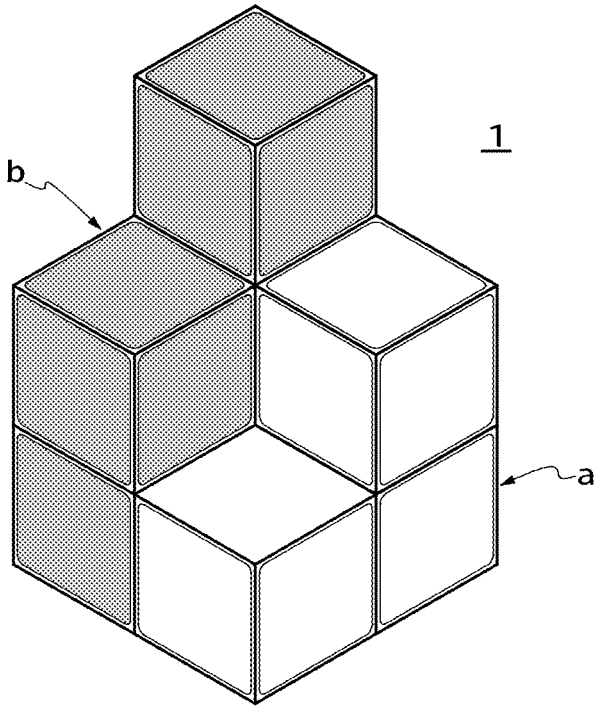
[Fig.39]
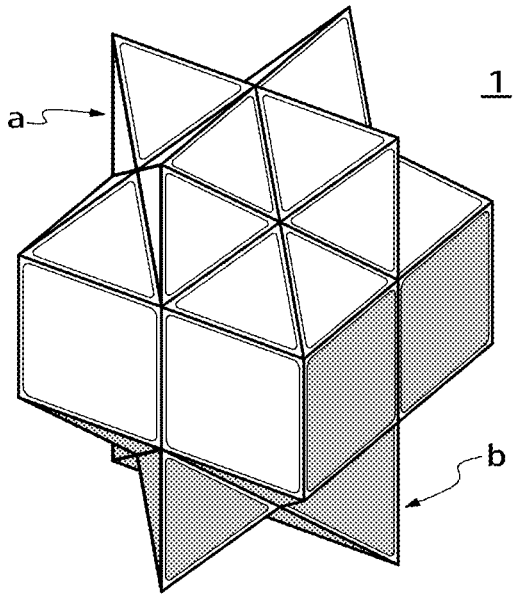

[Fig.40]
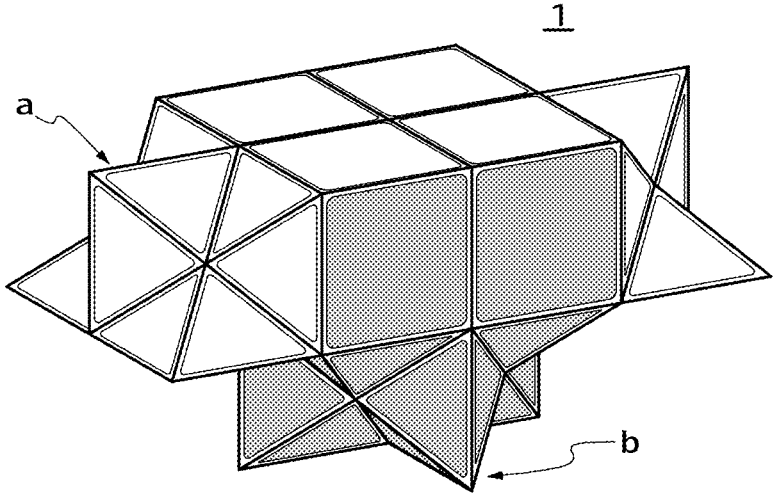

POLYHEDRAL TOY

TECHNICAL FIELD

The present invention relates to a polyhedral toy, which can be transformed from a form of a cuboid or a cube into various forms.

BACKGROUND ART

Hitherto, there has been known a cube toy which is called "Yoshimoto Cube", and a configuration thereof and a manufacturing method therefor are disclosed in Patent Literature 1.

Yoshimoto Cube is formed of two toy main bodies, which can basically be fitted to each other by male/female fitting and can further be transformed between a stellated polyhedron and a cube.

When the two toy main bodies are referred to as "toy main body A" and "toy main body B", the toy main body A and the toy main body B are each formed of eight polyhedral unit bodies.

Playing methods of Yoshimoto Cube mainly include two patterns.

One of the patterns is as follows.

The form illustrated in FIG. 1 of Patent Literature 1 is an initial form of the toy main body A. When the toy main body A is unfolded from this state around a division line 14 (see FIG. 1 of Patent Literature 1), the toy main body B of a stellated polyhedron appears from the inside. The toy main body B of a stellated polyhedron is taken out and separated from the toy main body A. After the toy main body B is separated from the toy main body A, the toy main body A is unfolded to complete the stellated polyhedron.

Another one of the patterns is as follows.

In the state of the initial form of the toy main body A, colors of squares forming the toy main body A appear on surfaces of the cube. The toy main body A is unfolded from this state around a division line intersecting the division line 14 to transform the toy main body A into the cube of the toy main body B so that colors of the squares forming the toy main body B appear.

That is, the playing methods of Yoshimoto Cube include a method of reversing surfaces of the cube of the toy main body A or the toy main body B to transform the cube into a cube of another color, and a method of transforming the toy main body A or the toy main body B between a cube and a stellated polyhedron.

However, the playing methods such as the transformation of the toy main body A or the toy main body B into a cube of another color and the transformation of the toy main body A or the toy main body B between a cube and a stellated polyhedron are limited in playing patterns.

Moreover, the playing methods basically involve the use of the toy main body A and the toy main body B in pair, and playing methods involving individual use of the toy main body A and the toy main body B are also limited.

Further, the playing methods basically involve the use of the toy main body A and the toy main body B in pair, and extensibility for achieving a wide variety of contents of play, such as combination of two or more cube toys, was poor.

CITATION LIST

Patent Literature

[PTL 1] JP S63-36272 A

SUMMARY OF INVENTION

Technical Problem

The playing methods of Yoshimoto Cube had limited patterns. Accordingly, the invention of the present application has an object to provide a wide variety of playing patterns with regard to playing methods of a polyhedral toy which is formed of polyhedral pieces similarly to Yoshimoto Cube, and to provide playing patterns which cannot be predicted in terms of change in forms with regard to a polyhedral toy, thereby enhancing elements of puzzles.

Moreover, the invention of the present application has an object to provide a polyhedral toy which can be enjoyed in terms of change in forms thereof even when only one polyhedral toy is used, and to provide a polyhedral toy having extensibility for achieving a wide variety of contents of play through combination of two or more polyhedral toys.

Solution to Problem

According to the present invention, there is provided a polyhedral toy including eight polyhedral pieces, wherein the polyhedral pieces are each formed with, among six faces of a cube, three faces adjacent to one another being left remaining and another three faces being removed, to thereby form three quadrangular pyramids having the remaining three faces serving as bottom faces, and the polyhedral pieces each include a triangle surface formed of six faces other than respective side faces of the quadrangular pyramids placed on one another.

The bottom faces include a first face and a second face, which perpendicularly intersect each other in a vertical direction in plan view on the triangle surfaces, and a third face, which perpendicularly intersects each of the first face and the second face in a horizontal direction.

The polyhedral pieces are arranged so that, in plan view on a top face of the polyhedral toy having been unfolded into a cuboid shape of two rows and four columns, in each of the first row and the second row, the triangle surface, the third face, the third face, and the triangle surface of the polyhedral pieces are arranged in the stated order.

The polyhedral pieces are coupled so that: a polyhedral piece located at a first row/first column position and a polyhedral piece located at a first row/second column position are coupled to each other at respective sides of first faces which are adjacent to each other; the polyhedral piece located at the first row/second column position and a polyhedral piece located at a first row/third column position are coupled to each other at respective sides of a second face and a first face, which are arranged on the triangle surfaces on the bottom faces of the polyhedral toy and face each other; and the polyhedral piece located at the first row/third column position and a polyhedral piece located at a first row/fourth column position are coupled to each other at respective sides of second faces which are adjacent to each other. Moreover, the polyhedral pieces are coupled so that: a polyhedral piece located at a second row/first column position and a polyhedral piece located at a second row/second column position are coupled to each other at respective sides of second faces which are adjacent to each other; the polyhedral piece located at the second row/second column position and a polyhedral piece located at a second row/third column position are coupled to each other at respective sides of a first face and a second face, which are arranged on the triangle surfaces on the bottom face of the polyhedral toy and face each other; and the polyhedral piece located at the second row/third column position and a polyhedral piece located at a second row/fourth column position are coupled to each other at respective sides of first surfaces which are adjacent to each other.

Further, the polyhedral pieces are coupled so that the polyhedral pieces in the first column are coupled to each other at respective sides of the third faces which are adjacent to each other, and the polyhedral pieces in the fourth column are coupled to each other at respective sides of the third faces which are adjacent to each other. (Invention of claim 1)

In the above-mentioned invention, the polyhedral toy includes at least one polyhedral toy to be played. (Invention of claim 2)

In the above-mentioned invention, the polyhedral toy includes at least two polyhedral toys to be played through fitting to each other by male/female fitting. (Invention of claim 3)

In the above-mentioned invention, the polyhedral toy includes at least two polyhedral toys to be played through transformation like building blocks. (Invention of claim 4)

Advantageous Effects of Invention

According to the invention of the present application, in place of a cube toy such as Yoshimoto Cube, there is proposed the polyhedral toy described above being capable of providing a wide variety of playing patterns, providing playing patterns which cannot be predicted in terms of change in forms, providing a polyhedral piece toy which can be enjoyed in terms of change in forms thereof even when only one polyhedral toy is used, and providing a polyhedral toy having extensibility for achieving a wide variety of contents of play through combination of two or more polyhedral toys.

BRIEF DESCRIPTION OF DRAWINGS

FIG. 1 is a perspective view for illustrating a polyhedral toy having been unfolded into a cuboid shape, as viewed from a top face side.

FIG. 2 is a perspective view for illustrating the polyhedral toy having been unfolded into the cuboid shape, as viewed from a bottom face side.

FIG. 3 is a perspective view for illustrating a polyhedral piece, which is extracted from the polyhedral toy of FIG. 1 and is located at a first row and first column position, as viewed from a top face side.

FIG. 4 is a perspective view for illustrating the polyhedral piece illustrated in FIG. 3, as viewed from a side.

FIG. 5 is a plan view for illustrating the polyhedral toy having been unfolded into the cuboid shape.

FIG. 6 is a front view for illustrating the polyhedral toy having been unfolded into the cuboid shape.

FIG. 7(A) is an illustration of the polyhedral toy without internal structure thereof, and is a sectional view taken along the line A-A of FIG. 6 and viewed from the direction indicated by the arrows.

FIG. 7(B) is an illustration of the polyhedral toy without internal structure thereof, and is a sectional view taken along the line B-B of FIG. 5 and viewed from the direction indicated by the arrows.

FIG. 7(C) is an illustration of the polyhedral toy without internal structure thereof, and is a sectional view taken along the line C-C of FIG. 5 and viewed from the direction indicated by the arrows.

FIG. 7(D) is an illustration of the polyhedral toy without internal structure thereof, and is a sectional view taken along the line D-D of FIG. 5 and viewed from the direction indicated by the arrows.

FIG. 7(E) is an illustration of the polyhedral toy without internal structure thereof, and is an end view taken along the line E-E of FIG. 5 and viewed from the direction indicated by the arrows.

FIG. 7(F) is an illustration of the polyhedral toy without internal structure thereof, and is an end view taken along the line F-F of FIG. 5 and viewed from the direction indicated by the arrows.

FIG. 7(G) is an illustration of the polyhedral toy without internal structure thereof, and is a sectional view taken along the line G-G of FIG. 5 and viewed from the direction indicated by the arrows.

FIG. 8 is a vertical sectional view for illustrating the polyhedral piece taken at a center thereof.

FIG. 9 is a perspective view for illustrating coupling structure for polyhedral pieces.

FIG. 10 is a perspective view for illustrating the polyhedral toy transformed in a playing pattern A.

FIG. 11 is a perspective view for illustrating the polyhedral toy transformed in the playing pattern A.

FIG. 12 is a perspective view for illustrating the polyhedral toy transformed in the playing pattern A.

FIG. 13 is a perspective view for illustrating the polyhedral toy transformed in the playing pattern A.

FIG. 14 is a perspective view for illustrating polyhedral toys transformed in a playing pattern B.

FIG. 15(A) is a perspective view for illustrating the polyhedral toys transformed in the playing pattern B.

FIG. 15(B) is a perspective view for illustrating toys "a" and "b" in a course of transformation.

FIG. 16 is a perspective view for illustrating the polyhedral toys transformed in the playing pattern B.

FIG. 17 a perspective view for illustrating the polyhedral toys transformed in the playing pattern B.

FIG. 18 is a perspective view for illustrating the polyhedral toys transformed in a playing pattern C.

FIG. 19 is a perspective view for illustrating the polyhedral toys transformed in the playing pattern C.

FIG. 20 is a perspective view for illustrating the polyhedral toys transformed in the playing pattern C.

FIG. 21 is a perspective view for illustrating the polyhedral toys transformed in the playing pattern C.

FIG. 22 is a perspective view for illustrating the polyhedral toys transformed in the playing pattern C.

FIG. 23 is a perspective view for illustrating the polyhedral toys transformed in the playing pattern C.

FIG. 24 is a perspective view for illustrating the polyhedral toys transformed in the playing pattern C.

FIG. 25(A) is a perspective view for illustrating the polyhedral toys transformed in a playing pattern D.

FIG. 25(B) is a perspective view for illustrating the toys "a" and "b" in a course of transformation.

FIG. 25(C) is a perspective view for illustrating the toys "a" and "b" in the course of transformation.

FIG. 26 is a perspective view for illustrating the polyhedral toys transformed in the playing pattern D.

FIG. 27 is a perspective view for illustrating the polyhedral toys transformed in the playing pattern D.

FIG. 28 is a perspective view for illustrating the polyhedral toys transformed in the playing pattern D.

FIG. 29 is a perspective view for illustrating the polyhedral toys transformed in the playing pattern D.

FIG. 30 is a perspective view for illustrating the polyhedral toys transformed in a playing pattern E.

FIG. 31 is a perspective view for illustrating the polyhedral toys transformed in the playing pattern E.

FIG. 32 is a perspective view for illustrating the polyhedral toys transformed in the playing pattern E.

FIG. 33 is a perspective view for illustrating the polyhedral toys transformed in the playing pattern E.

FIG. 34 is a perspective view for illustrating the polyhedral toys transformed in the playing pattern E.

FIG. 35 is a perspective view for illustrating the polyhedral toys transformed in the playing pattern E.

FIG. 36 is a perspective view for illustrating the polyhedral toys transformed in the playing pattern E.

FIG. 37 is a perspective view for illustrating the polyhedral toys transformed in the playing pattern E.

FIG. 38 is a perspective view for illustrating the polyhedral toys transformed in a playing pattern F.

FIG. 39 is a perspective view for illustrating the polyhedral toys transformed in a playing pattern G.

FIG. 40 is a perspective view for illustrating the polyhedral toys transformed in the playing pattern G.

DESCRIPTION OF EMBODIMENTS

A polyhedral toy (hereinafter simply referred to as "toy") 1 according to the present invention is formed of eight polyhedral pieces U1 to U8. In FIG. 1 and FIG. 2, illustration is given of the toy 1 in which the polyhedral pieces U1 to U8 have been unfolded into a cuboid shape of two rows and four columns.

In the Description, with regard to the eight polyhedral pieces U1 to U8, a configuration of the polyhedral piece U1 arranged at a first row and first column position in FIG. 1 is specified, and components of each of the polyhedral pieces U2 to U8 and components of the toy 1 are described based on the description of the polyhedral piece U1.

Thus, in the Description and each of the drawings, components of each of the polyhedral pieces U2 to U8 common to the components of the polyhedral piece U1 are denoted by the same names and reference symbols as those of the components of the polyhedral piece U1.

FIG. 3 and FIG. 4 are each an illustration of the polyhedral piece U1 illustrated in FIG. 1 and extracted from FIG. 1. When the polyhedral piece U1 is formed with, among six faces R1 to R6 of a cube R, three faces R1 to R3 adjacent to one another being left remaining and another three faces R4 to R6 being removed, to thereby form three quadrangular pyramids G1 to G3 having the remaining three faces R1 to R3 serving as bottom faces, the polyhedral piece U1 includes a triangle surface 10 formed of six triangular faces T1 to T6 other than respective side faces of the quadrangular pyramids G1 to G3 placed on one another.

With regard to the three faces R1 to R3, as illustrated in FIG. 3, the faces R1 and R2 extending in a vertical direction and being perpendicularly connected to each other are referred to as "first face R1" and "second face R2", respectively, and the face R3 extending in a horizontal direction and being perpendicularly connected to each of the first face R1 and the second face R2 is referred to as "third face R3".

Moreover, as illustrated in FIG. 4, the first face R1 has an upper horizontal side 11*u*, a lower horizontal side 11*d*, a left vertical side 12*l*, and a right vertical side 12*r*, and the second face R2 has an upper horizontal side 13*u*, a lower horizontal side 13*d*, a left vertical side 14*l*, and a right vertical side 14*r*. Among sides of the third face R3, a side adjacent to the lower horizontal side 11*d* is referred to as "first-face adjacent side 15", a side adjacent to the lower horizontal line 13*d* is referred to as "second-face adjacent side 16", a side parallel to the first-face adjacent side 15 is referred to as "parallel side 17", and a side parallel to the second-face adjacent side 16 is referred to as "parallel side 18".

As illustrated in FIG. 3 and FIG. 4, the quadrangular pyramids G1 to G3 are formed so as to have respective apices T at a point at which diagonal lines C of the cube R intersect each other, and ridgelines are formed along the diagonal lines C.

Among side faces of the quadrangular pyramids G1 to G3 formed as described above, side faces of the quadrangular pyramid G1 which are not placed on one another form the triangular face T1 and the triangular face T2. Similarly, side faces of the quadrangular pyramid G2 form the triangular face T3 and the triangular face T4. Similarly, side faces of the quadrangular pyramid G3 form the triangular face T5 and the triangular face T6.

In the case of the toy 1 in which the polyhedral pieces U1 to U8 each having the configuration described above are unfolded into a cuboid shape of two rows and four columns as illustrated in FIG. 1, in plan view on the top face of the toy 1, in each of the first row and the second row, there are arranged the triangle surface 10, the third face R3, the third face R3, and the triangle surface 10 in the stated order.

Meanwhile, as illustrated in FIG. 2, in bottom view of the toy 1, in each of the first row and the second row, there are arranged the third face R3, the triangle surface 10, the triangle surface 10, and the third face R3 in the stated order.

The polyhedral pieces U1 to U8 have the following coupling relationship.

In the drawings of the present application, parts at which the coupling relationship of the polyhedral pieces U1 to U8 are given are indicated by bold lines.

The polyhedral piece U2 and the polyhedral piece U3 located at a first row/third column position are coupled to each other, as illustrated in FIG. 2 and in FIG. 7(A) and FIG. 7(B), at the upper horizontal line 13*u* of the second face R2 and the upper horizontal side 11*u* of the first face R1 which face each other.

The polyhedral piece U2 and the polyhedral piece U3 located at a first row/third column position are coupled to each other, as illustrated in FIG. 2 and in FIG. 7(A) and FIG. 7(B), at the upper horizontal line 13*u* of the second face R2 and the upper horizontal line 11*u* of the first face R1 which face each other.

The polyhedral piece U3 and the polyhedral piece U4 located at a first row/fourth column position are coupled to each other, as illustrated in FIG. 1 and FIG. 2 and in FIG. 7(A) and FIG. 7(B), at the left vertical sides 14*l* of the second faces R2 which are adjacent to each other.

The polyhedral piece U5 located at a second row/first column position and the polyhedral piece U6 located at a second row/second column position are coupled to each other, as illustrated in FIG. 1 and FIG. 2 and in FIG. 7(A), at the left vertical sides 14*l* of the second faces R2 which are adjacent to each other.

The polyhedral piece U6 and the polyhedral piece U7 located at a second row/third column position are coupled to each other, as illustrated in FIG. 2 and in FIG. 7(A) and FIG. 7(C), at the upper horizontal line 13*u* of the first face R1 and the upper horizontal line 13*u* of the second face R2 which face each other.

The polyhedral piece U7 and the polyhedral piece U8 located at a second row/fourth column position are coupled to each other, as illustrated in FIG. 1 and FIG. 2 and in FIG.

7(A), at the right vertical sides 12*r* of the first faces R1 which are adjacent to each other.

Moreover, the polyhedral piece U1 and the polyhedral piece U5 are coupled to each other, as illustrated in FIG. 1 and FIG. 2 and in FIG. 7(A) and FIG. 7(D), at the parallel sides 17 and 18 of the third faces R3 which are adjacent to each other.

Moreover, the polyhedral piece U4 and the polyhedral piece U8 are coupled to each other, as illustrated in FIG. 1 and FIG. 2 and in FIG. 7(A) and FIG. 7(G), at the parallel sides 17 and 18 of the third faces R3 which are adjacent to each other.

That is, as illustrated in the drawings, the pair of the polyhedral piece U1 and the polyhedral piece U2, the pair of the polyhedral piece U3 and the polyhedral piece U4, and the pair of the polyhedral piece U2 and the polyhedral piece U3 are each in the coupling relationship, and the pair of the polyhedral piece U5 and the polyhedral piece U6, the pair of the polyhedral piece U7 and the polyhedral piece U8, and the pair of the polyhedral piece U6 and the polyhedral piece U7 are each in the coupling relationship.

However, a pair of the polyhedral piece U2 and the polyhedral piece U6 is not in the coupling relationship, and a pair of the polyhedral piece U3 and the polyhedral piece U7 also are not in the coupling relationship.

Each of the polyhedral pieces U1 to U8 has the following structure. Specifically, as illustrated in FIG. 8, each of the polyhedral pieces U1 to U8 is manufactured with a main body 2 and a lid member 3. The main body 2 includes the first face R1, the second face R2, and the triangle surface 10, and the third face R3 is open. The lid member 3 is configured to close the open third face R3. The main body 2 and the lid member 3 are each made of a synthetic resin.

In the main body 2, a cylindrical portion 20 is formed so as to extend from a back side of the triangle surface 10 toward the opening, and a circular column 30 to be fitted into the cylindrical portion 20 is formed on the lid member 3. Through fitting of the circular column 30 to the cylindrical portion 20, the opening is closed. As a result, each of the polyhedral pieces U1 to U8 is manufactured.

In order to manufacture the polyhedral pieces U1 to U8 each having the configuration described above, it is only required that male and female dies be prepared for the main body 2 and the lid member 3 and that a thermoplastic resin be formed through injection molding onto the dies using, for example, an injection molding machine.

Specific coupling structure provided at each of the coupling positions of the polyhedral pieces U1 to U8 is as follows. Specifically, at each of the coupling positions at which any two faces of the first face R1 to the third face R3 are coupled to each other, a tape material 4 having a rectangular shape capable of covering each of the two faces is prepared, and halves of the tape material 4 are applied to the two faces, respectively. At the same time, at each of the coupling positions at which any two faces of the triangular faces T1 to T6 are coupled to each other, a tape material 5 having a rhombic shape (parallelogram shape) capable of covering each of the two faces of the triangular faces T1 to T6 is prepared, and halves of the tape material 5 are applied to the two faces on a back side when the tape material 2 having a rectangular shape is applied on a front side.

For example, in a case of the coupling structure for the polyhedral piece U2 and the polyhedral piece U3 as illustrated in FIG. 9, the upper horizontal line 13*u* of the second face R2 and the upper horizontal side 11*u* of the first face R1, which are adjacent to each other, are brought into abutment against each other and affixed with the tape material 4, and the triangular faces T1 are affixed with the tape material 5.

On the first faces R1 to the third faces R3 of the polyhedral pieces U1 to U8, color tapes of various types may be applied, or a tape having a pattern thereon may be applied. When the tape materials 2 and 4 are provided, those tapes may be applied on the tape materials. However, the tape materials 2 and 4 themselves may be provided as color tapes.

Examples of playing methods of the toy 1 include the following patterns.

<Playing Pattern A>

In the playing pattern A, one toy 1 is prepared, and the toy 1 is transformed into various forms.

The toy 1 can be transformed from the form of eight polyhedral pieces U1 to U8 to a form of four cubes with the arrangement of two cubes in the vertical direction by two cubes in the horizontal direction, as illustrated in FIG. 10.

Moreover, as illustrated in FIG. 11, the toy 1 can be transformed into a substantially L-shape of four cubes with the arrangement of three cubes in the vertical direction. Further, as illustrated in FIG. 12 and FIG. 13, the toy 1 can be transformed so that two cubes in the vertical direction and two cubes in the horizontal direction intersect each other.

<Playing Pattern B>

In the playing pattern B, two toys 1 are prepared for play. With the two toys being referred to as "toy "a"" and "toy "b"", respectively, the toy "a" and the toy "b" are fitted to each other by male/female fitting, or the toy "a" and the toy "b" are each transformed and thereafter are combined with each other to be transformed into a form with the arrangement of one stage in the horizontal direction.

In the drawings, the faces R1 to R3 and the triangle surface 10 of the toy "a" are illustrated without any pattern thereon (hereinafter simply referred to as "surface color"), and the faces R1 to R3 and the triangle surface 10 of the toy "b" are illustrated with hatching (hereinafter simply referred to as "surface color").

The form in which the toy "a" and the toy "b" are fitted to each other by male/female fitting corresponds to a state in which the polyhedral pieces U1 to U8 of each of the toy "a" and the toy "b" have the following coupling relationship.

First, in plan view on the top face of the toy "a" in which the polyhedral pieces U1 to U8 have been unfolded into the cuboid shape of two rows and four columns, the polyhedral piece U6, the polyhedral piece U5, the polyhedral piece U1, and the polyhedral piece U2 are arranged in the first row in the stated order from the first column to the fourth column, and the polyhedral piece U7, the polyhedral piece U8, the polyhedral piece U4, and the polyhedral piece U3 are arranged in the second row in the stated order from the first column to the fourth column. Further, the respective triangle surfaces 10 of the polyhedral pieces U1 to U8 face one another.

Meanwhile, in plan view on the top face of the toy "b" in which the polyhedral pieces U1 to U8 have been unfolded into the cuboid shape of two rows and four columns, the polyhedral piece U1, the polyhedral piece U2, the polyhedral piece U3, and the polyhedral piece U4 are arranged in the first row in the stated order from the first column to the fourth column, and the polyhedral piece U5, the polyhedral piece U6, the polyhedral piece U7, and the polyhedral piece U8 are arranged in the second row in the stated order from the first column to the fourth column. Moreover, the respective triangle surfaces 10 of the polyhedral pieces U1 to U8 face one another.

The triangle surfaces 10 of the toy "a" and the toy "b" in the male/female fitting are brought to face each other to fit the toy "a" and the toy "b" to each other, thereby being capable of transforming the toy "a" and the toy "b" into the cuboid of two rows and four columns as illustrated in FIG. 14.

FIG. 15(A) is an illustration of a state in which the toy "a" and the toy "b" are each transformed and thereafter are combined with each other into a cross shape. First, the toy "a" and the toy "b" are transformed as illustrated in FIG. 15(B). After that, the toy "a" and the toy "b" are combined and stacked in the horizontal direction as illustrated in FIG. 15(A). In such a manner, the toy "a" and the toy "b" can be played like building blocks.

FIG. 16 is an illustration of a state in which the toy "a" and the toy "b" are combined in a staggered pattern, and FIG. 17 is an illustration of a state in which the toy "a" and the toy "b" are combined in a curb-like pattern. In those cases, the toy "a" and the toy "b" can be played like building blocks.

<Playing Pattern C>

In the playing pattern C, the two toys 1 including the toy "a" and the toy "b" are prepared and are fitted to each other by male/female fitting to be transformed into a cube with the arrangement of two cubes in the vertical direction, two cubes in the horizontal direction, and two cubes in a height direction.

On this occasion, as illustrated in FIG. 18 to FIG. 24, the faces of the cubes can be transformed into different surface colors. Thus, the toy "a" and the toy "b" can be played like a puzzle.

<Playing Pattern D>

In the playing pattern D, two toys 1 including the toy "a" and the toy "b" are prepared, and can be played by transforming the toy "a" and the toy "b" into the same form.

FIG. 25(A) is an illustration of a case in which the toy "a" and the toy "b" in the form of having the two same mountain shapes are combined and transformed. First, the toy "a" and the toy "b" are each transformed from the form illustrated in FIG. 25(B) into the form illustrated in FIG. 25(C). After that, as illustrated in FIG. 25(A), the toy "a" and the toy "b" are combined and stacked in the horizontal direction and the vertical direction. In such a manner, the toy "a" and the toy "b" are played like building blocks.

FIG. 26 is an illustration of a case in which the toy "a" and the toy "b" in the form of having the same two L-shapes are combined and transformed. FIG. 27 is an illustration of a case in which the toy "a" and the toy "b" in the form of having the same two mountain shapes are combined and transformed in a staggered pattern. FIG. 28 is an illustration of a case in which the toy "a" and the toy "b" in the form of having the same two S-shapes are combined and transformed in a staggered pattern. In each of the above-mentioned cases, the toy "a" and the toy "b" can be played like building blocks.

FIG. 29 is an illustration of a state in which the toy "a" and the toy "b" are fitted to each other so that the toy "a" and the toy "b" in the form of having the same two L-shapes are combined and transformed in a staggered pattern.

<Playing Pattern E>

In the playing pattern E, two toys 1 including the toy "a" and the toy "b" are prepared, and the toy "a" and the toy "b" are transformed into different forms and thereafter stacked in the horizontal direction and the vertical direction to be transformed into a form in which the toy "a" and the toy "b" are combined in two stages like building blocks.

That is, as illustrated in FIG. 30 to FIG. 37, the toy "a" and the toy "b" can be transformed into a form of being randomly combined like building blocks.

<Playing Pattern F>

In the playing pattern F, two toys 1 including the toy "a" and the toy "b" are prepared, and the toy "a" and the toy "b" are transformed into different forms and thereafter transformed into a form of being combined in three stages like building blocks as illustrated in FIG. 38.

<Playing Pattern G>

When the toy "a" and the toy "b" are to be transformed in each of the playing patterns described above, the toy "a" and the toy "b" are transformed so that the faces R1 to R3 appear on the outer side. However, in the playing pattern G, the toy "a" and the toy "b" are transformed so that the triangle surfaces 10 appear on the outer side and thereafter transformed like building blocks as illustrated in FIG. 39 and FIG. 40.

As described above, even when only one toy 1 is used as illustrated in the playing pattern A of the toy 1, the toy 1 can be enjoyed in terms of change in forms.

Moreover, as in the playing patterns B to G, a wide variety of playing patterns can be provided, and on this occasion, playing patterns which cannot be predicted in terms of change in forms can be provided.

Further, elements of puzzles with focus on whether combinations of surface colors of cubes can be produced as in the playing pattern C can be incorporated.

In the playing patterns described above, the toy "a" and the toy "b" are used as the two toys 1. However, two or more toys 1 may be prepared and transformed so that those toys can be stacked in the horizontal direction and the vertical direction and played like building blocks.

The present invention is not limited to the embodiments described above, and various modifications can be made by a person having ordinary skill in the art within the technical concept of the present invention.

REFERENCE SIGNS LIST

1 polyhedral toy
10 triangle surface
11*u*, 13*u* upper horizontal side
11*d*, 13*d* lower horizontal side
12*l*, 14*l* left vertical side
12*r*, 14*r* right vertical side
15 first-face adjacent surface
16 second-face adjacent surface
17, 18 parallel side
2 main body
3 lid member
20 cylindrical portion
30 circular column
4, 5 tape
U1 to U8 polyhedral piece
R cube
R1 first face
R2 second face
R1 to R6 six faces of cube
R3 third face
G1 to G3 quadrangular pyramid
T1 to T6 triangular face
C diagonal lines
T apex

The invention claimed is:

1. A polyhedral toy, comprising eight polyhedral pieces, wherein the polyhedral pieces are each formed with, among six faces of a cube, three faces adjacent to one another being left remaining and another three faces being removed, to thereby form three quadrangular pyramids having the remaining three faces serving as bottom faces, and the polyhedral pieces each include a triangle surface formed of six faces other than respective side faces of the quadrangular pyramids placed on one another, wherein, when the bottom faces include a first face and a second face, which perpendicularly intersect each other in a vertical direction in plan view on the triangle surfaces, and a third face, which perpendicularly intersects each of the first face and the second face in a horizontal direction, the polyhedral pieces are arranged so that, in plan view on a top face of the polyhedral toy having been unfolded into a cuboid shape of two rows and four columns, in each of the first row and the second row, the triangle surface, the third face, the third face, and the triangle surface of the polyhedral pieces are arranged in the following order, and wherein, the polyhedral pieces are coupled so that:

a polyhedral piece located at a first row and first column position and a polyhedral piece located at a first row and second column position are coupled to each other at respective sides of first faces which are adjacent to each other;

the polyhedral piece located at the first row and second column position and a polyhedral piece located at a first row and third column position are coupled to each other at respective sides of a second face and a first face, which are arranged on the triangle surfaces on the respective bottom faces and face each other;

the polyhedral piece located at the first row and third column position and a polyhedral piece located at a first row and fourth column position are coupled to each other at respective sides of second faces which are adjacent to each other;

a polyhedral piece located at a second row and first column position and a polyhedral piece located at a second row and second column position are coupled to each other at respective sides of second faces which are adjacent to each other;

the polyhedral piece located at the second row and second column position and a polyhedral piece located at a second row and third column position are coupled to each other at respective sides of a first face and a second face, which are arranged on the triangle surfaces on the respective bottom faces and face each other;

the polyhedral piece located at the second row and third column position and a polyhedral piece located at a second row and fourth column position are coupled to each other at respective sides of first surfaces which are adjacent to each other;

the polyhedral piece located at the first row and first column position and the polyhedral piece located at the second row and first column position are coupled to each other at respective sides of the third faces which are adjacent to each other; and the polyhedral piece located at the first row and fourth column position and the polyhedral piece located at the second row and fourth column position are coupled to each other at respective sides of the third faces which are adjacent to each other.

2. The polyhedral toy according to claim 1, wherein the polyhedral toy comprises at least one polyhedral toy to be played.

3. The polyhedral toy according to claim 1, wherein the polyhedral toy comprises at least two polyhedral toys to be played through fitting to each other by male/female fitting.

4. The polyhedral toy according to claim 1, wherein the polyhedral toy comprises at least two polyhedral toys to be played through transformation like building blocks.

5. A polyhedral toy, comprising:

eight polyhedral pieces, each polyhedral piece comprising:

three square faces, each square face having four sides, wherein:

a first square face perpendicularly intersects a second square face at a first side of the first square face and a first side of the second square face;

the first square face perpendicularly intersects a third square face at a second side of the first square face and a first side of the third square face; and the second square face perpendicularly intersects the third square face at a second side of the second square face and a second side of the third square face; and a surface comprising six triangular faces, each triangular face comprising a base side, two leg sides, and an apex, wherein:

the surface intersects the first square face at a base side of a first triangular face and a third side of the first square face;

the surface intersects the first square face at a base side of a second triangular face and a fourth side of the first square face;

the surface intersects the second square face at a base side of a third triangular face and a third side of the second square face;

the surface intersects the second square face at a base side of a fourth triangular face and a fourth side of the second square face;

the surface intersects the third square face at a base side of a fifth triangular face and a third side of the third square face;

the surface intersects the third square face at a base side of a sixth triangular face and a fourth side of the second square face; and the apices of the six triangular faces meet at a central apex;

wherein for each polyhedral piece:

one of the square faces of the polyhedral piece is pivotably coupled to a first one of the other polyhedral pieces; and a different one of the square faces of the polyhedral piece is pivotably coupled to a second one of the other polyhedral pieces.

6. The polyhedral toy of claim 5, further comprising:

a first tape portion adhered to one of the square faces of a first polyhedral piece of the eight polyhedral pieces and one of the square faces of a second polyhedral piece of the eight polyhedral pieces to pivotably couple the first polyhedral piece to the second polyhedral piece;

a second tape portion adhered to one of the triangular faces of the second polyhedral piece and one of the triangular faces of a third polyhedral piece of the eight polyhedral pieces to pivotably couple the second polyhedral piece to the third polyhedral piece;

a third tape portion adhered to one of the square faces of the third polyhedral piece and one of the square faces of a fourth polyhedral piece of the eight polyhedral pieces to pivotably couple the third polyhedral piece to the fourth polyhedral piece;

a fourth tape portion adhered to one of the square faces of the fourth polyhedral piece and one of the square faces of a fifth polyhedral piece of the eight polyhedral pieces to pivotably couple the fourth polyhedral piece to the fifth polyhedral piece;

a fifth tape portion adhered to one of the square faces of the fifth polyhedral piece and one of the square faces of a sixth polyhedral piece of the eight polyhedral pieces to pivotably couple the fifth polyhedral piece to the sixth polyhedral piece;

a sixth tape portion adhered to one of the triangular faces of the sixth polyhedral piece and one of the triangular faces of a seventh polyhedral piece of the eight polyhedral pieces to pivotably couple the sixth polyhedral piece to the seventh polyhedral piece;

a seventh tape portion adhered to one of the square faces of the seventh polyhedral piece and one of the square faces of an eighth polyhedral piece of the eight polyhedral pieces to pivotably couple the seventh polyhedral piece to the eighth polyhedral piece; and an eighth tape portion adhered to one of the square faces of the eighth polyhedral piece and one of the square faces of the first polyhedral piece to pivotably couple the eighth polyhedral piece to the first polyhedral piece.

7. The polyhedral toy of claim 5, wherein:

the eight polyhedral pieces are arranged in a 2×4×1 configuration comprising two rows and four columns to form the polyhedral toy having a top side, a bottom side, a first side, a second side opposite the first side, a third side orthogonal to the first and second sides, and a fourth side opposite the third side, such that:

the first polyhedral piece is pivotably coupled to the second polyhedral piece on the first side;

the second polyhedral piece is pivotably coupled to the third polyhedral piece on the bottom side;

the third polyhedral piece is pivotably coupled to the fourth polyhedral piece on the first side;

the fourth polyhedral piece is pivotably coupled to the fifth polyhedral piece on the bottom side;

the fifth polyhedral piece is pivotably coupled to the sixth polyhedral piece on the second side;

the sixth polyhedral piece is pivotably coupled to the seventh polyhedral piece on the bottom side;

the seventh polyhedral piece is pivotably coupled to the eighth polyhedral piece on the second side; and the eighth polyhedral piece is pivotably coupled to the first polyhedral piece on the bottom side.

8. The polyhedral toy of claim 7, further comprising:

a first tape portion adhered to one of the square faces of the first polyhedral piece and one of the square faces of the second polyhedral piece to pivotably couple the first polyhedral piece to the second polyhedral piece;

a second tape portion adhered to one of the triangular faces of the second polyhedral piece and one of the triangular faces of the third polyhedral piece to pivotably couple the second polyhedral piece to the third polyhedral piece;

a third tape portion adhered to one of the square faces of the third polyhedral piece and one of the square faces of the fourth polyhedral piece to pivotably couple the third polyhedral piece to the fourth polyhedral piece;

a fourth tape portion adhered to one of the square faces of the fourth polyhedral piece and one of the square faces of the fifth polyhedral piece to pivotably couple the fourth polyhedral piece to the fifth polyhedral piece;

a fifth tape portion adhered to one of the square faces of the fifth polyhedral piece and one of the square faces of the sixth polyhedral piece to pivotably couple the fifth polyhedral piece to the sixth polyhedral piece;

a sixth tape portion adhered to one of the triangular faces of the sixth polyhedral piece and one of the triangular faces of the seventh polyhedral piece to pivotably couple the sixth polyhedral piece to the seventh polyhedral piece;

a seventh tape portion adhered to one of the square faces of the seventh polyhedral piece and one of the square faces of the eighth polyhedral piece to pivotably couple the seventh polyhedral piece to the eighth polyhedral piece; and an eighth tape portion adhered to one of the square faces of the eighth polyhedral piece and one of the square faces of the first polyhedral piece to pivotably couple the eighth polyhedral piece to the first polyhedral piece.

* * * * *